US010092156B2

(12) United States Patent
Bravo

(10) Patent No.: US 10,092,156 B2
(45) Date of Patent: Oct. 9, 2018

(54) GROUT CLEANING ASSEMBLY

(71) Applicant: Michael Bravo, Placentia, CA (US)

(72) Inventor: Michael Bravo, Placentia, CA (US)

( * ) Notice: Subject to any disclaimer, the term of this patent is extended or adjusted under 35 U.S.C. 154(b) by 0 days.

(21) Appl. No.: 15/408,919

(22) Filed: Jan. 18, 2017

(65) Prior Publication Data

US 2018/0199783 A1 Jul. 19, 2018

(51) Int. Cl.

| | |
|---|---|
| ***A47L 11/03*** | (2006.01) |
| ***A47L 11/292*** | (2006.01) |
| ***A47L 11/30*** | (2006.01) |
| ***A47L 11/40*** | (2006.01) |

(52) U.S. Cl.

CPC ..... *A47L 11/302* (2013.01); *A47L 11/4008* (2013.01); *A47L 11/4041* (2013.01); *A47L 11/4044* (2013.01); *A47L 11/4088* (2013.01)

(58) Field of Classification Search

CPC A47L 11/302; A47L 11/4008; A47L 11/4041; A47L 11/4044; A47L 11/4088; A47L 11/34

See application file for complete search history.

(56) References Cited

U.S. PATENT DOCUMENTS 3,694,848 A * 10/1972 Alcala ..... A47L 5/14 15/346
4,586,211 A * 5/1986 Phillips ..... A47L 11/19 15/179
4,956,032 A 9/1990 Hahn et al.
5,187,827 A * 2/1993 Wei ..... A46B 13/06 15/22.1
5,412,829 A * 5/1995 Hefner ..... A46B 7/02 15/160
5,543,178 A 8/1996 Smith
5,651,727 A 7/1997 Weinstein et al.
5,988,954 A 11/1999 Gaskin et al.
6,059,475 A * 5/2000 Jafarmadar ..... A46B 13/04 15/50.3
6,668,463 B2 12/2003 Dewberry
7,232,280 B2 6/2007 Bernardi et al.
8,747,190 B2 6/2014 Smith
2006/0236474 A1* 10/2006 Jaffe ..... A46B 5/0008 15/28
2010/0125969 A1* 5/2010 Genna ..... A47L 5/365 15/320
2010/0236010 A1* 9/2010 Johnson ..... A47L 11/34 15/320
2015/0320286 A1* 11/2015 Tronson, Sr. ..... A47L 11/4041 15/52.1

* cited by examiner

*Primary Examiner* — Dung Van Nguyen

(57) ABSTRACT

A grout cleaning assembly includes a housing that has a handle portion and a suction portion. A scrubbing unit is rotatably attached to the housing and the scrubbing unit is positioned on the suction portion. Thus, the scrubbing unit scrubs a grout from a support surface. A first port is coupled to the handle portion. The first port may be fluidly coupled to a fluid source thereby facilitating the first port to directing a fluid onto the scrubbing unit. A second port is coupled to the handle portion. The second port may be fluidly coupled to a vacuum thereby facilitating the second port to suctionally urge the fluid and the grout into the vacuum when the scrubbing unit scrubs the grout from the support surface.

14 Claims, 5 Drawing Sheets

GROUT CLEANING ASSEMBLY

BACKGROUND OF THE DISCLOSURE

Field of the Disclosure

The disclosure relates to cleaning devices and more particularly pertains to a new cleaning device for cleaning a grout from a support surface.

Summary of the Disclosure

An embodiment of the disclosure meets the needs presented above by generally comprising a housing that has a handle portion and a suction portion. A scrubbing unit is rotatably attached to the housing and the scrubbing unit is positioned on the suction portion. Thus, the scrubbing unit scrubs a grout from a support surface. A first port is coupled to the handle portion. The first port may be fluidly coupled to a fluid source thereby facilitating the first port to directing a fluid onto the scrubbing unit. A second port is coupled to the handle portion. The second port may be fluidly coupled to a vacuum thereby facilitating the second port to suctionally urge the fluid and the grout into the vacuum when the scrubbing unit scrubs the grout from the support surface.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
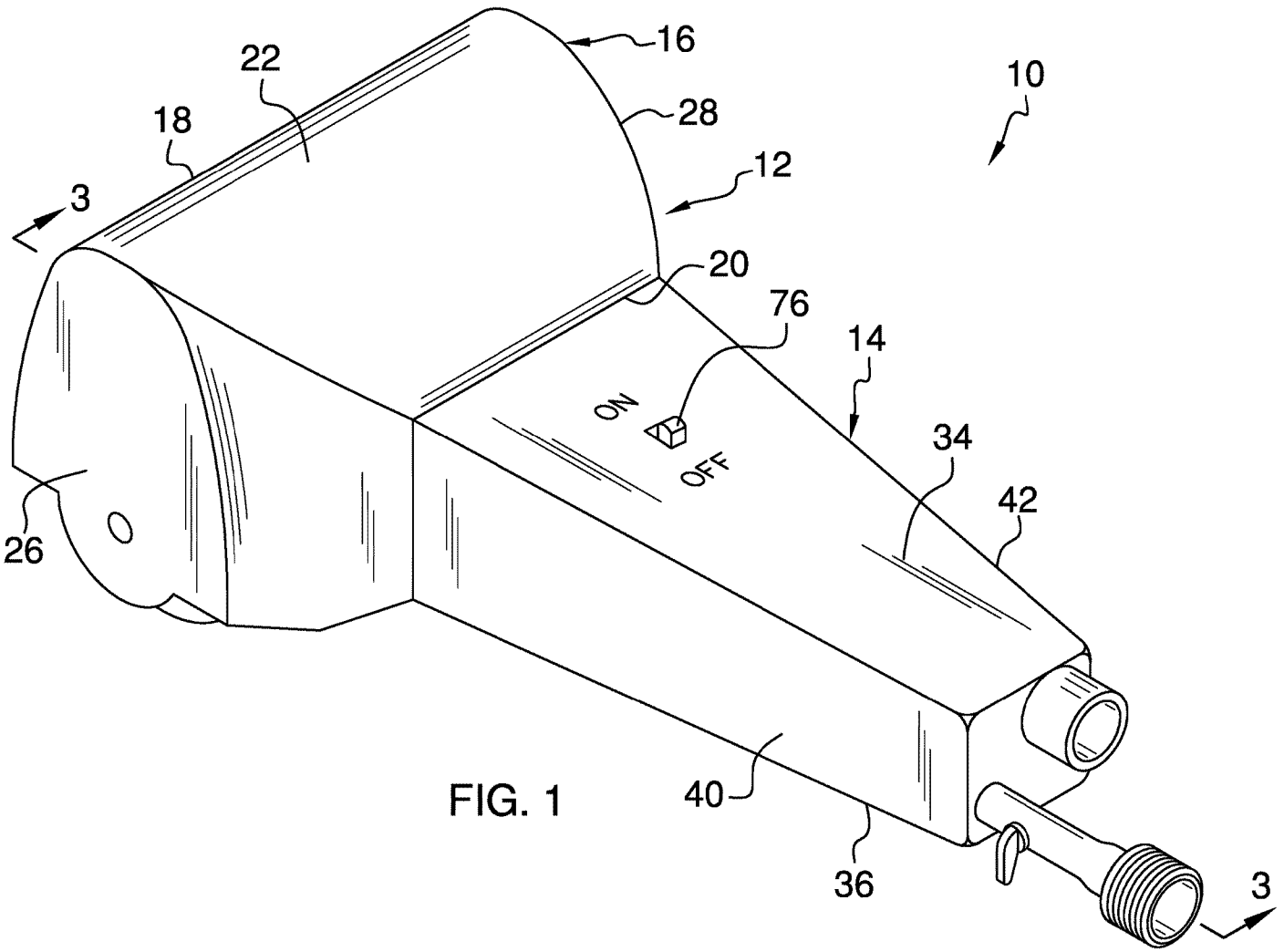
FIG. 1 is a top perspective view of a grout cleaning assembly according to an embodiment of the disclosure.
Figure 2:
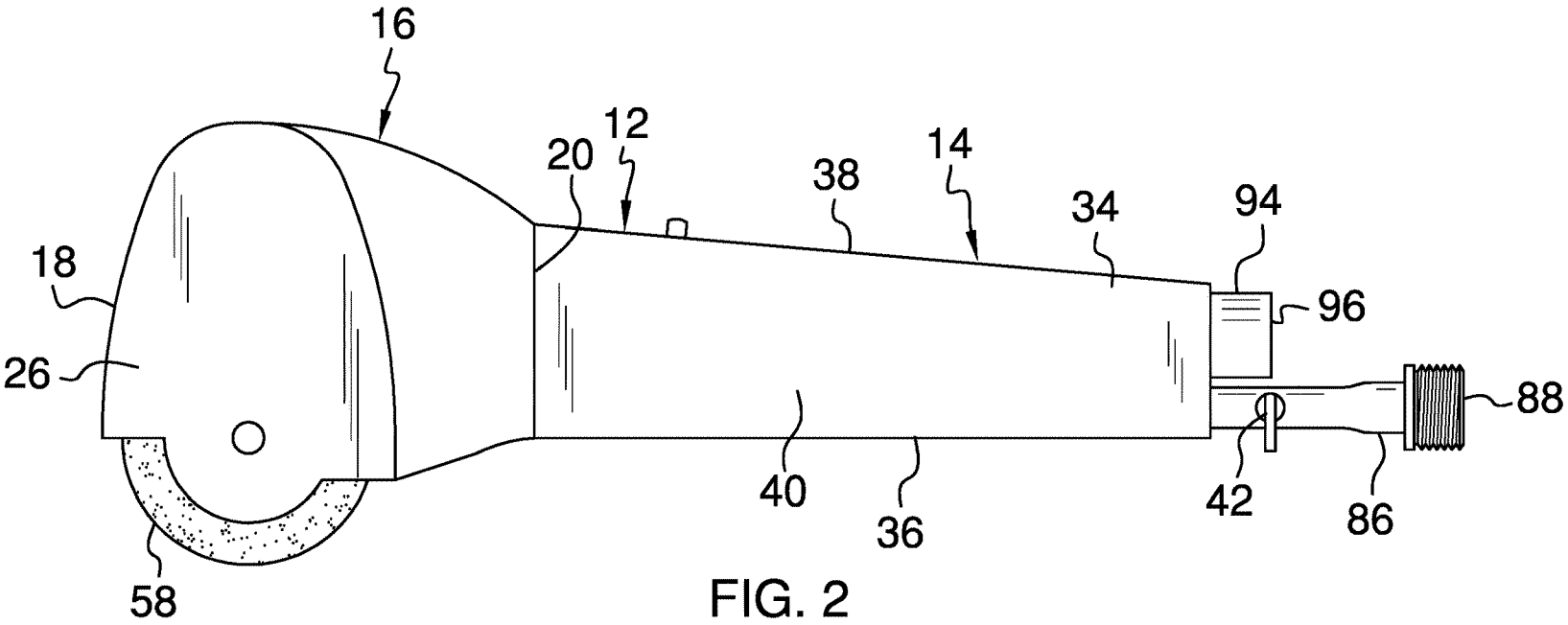
FIG. 2 is a left side view of an embodiment of the disclosure.
Figure 3:
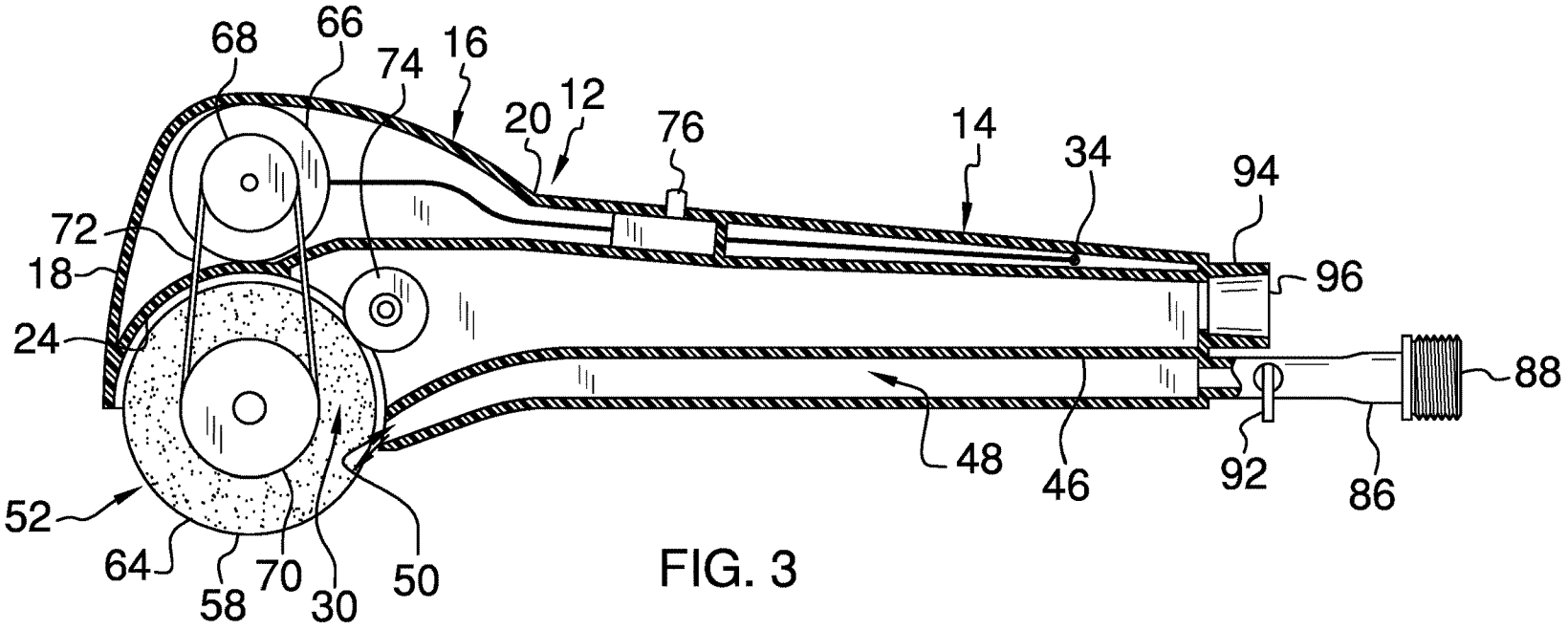
FIG. 3 is a cross sectional view taken along line 3-3 of FIG. 1 of an embodiment of the disclosure.
Figure 4:
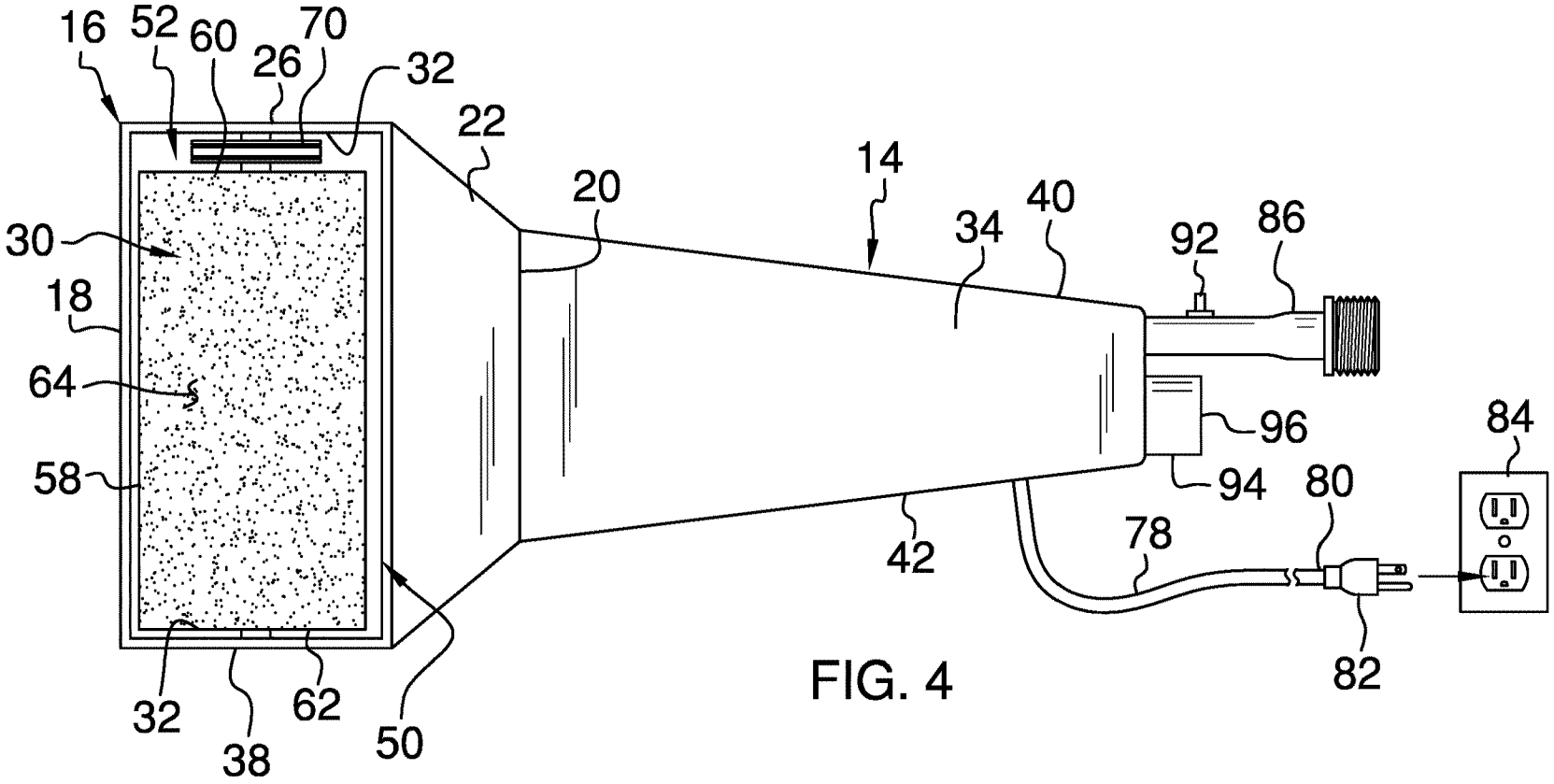
FIG. 4 is a bottom view of an embodiment of the disclosure.
Figure 5:
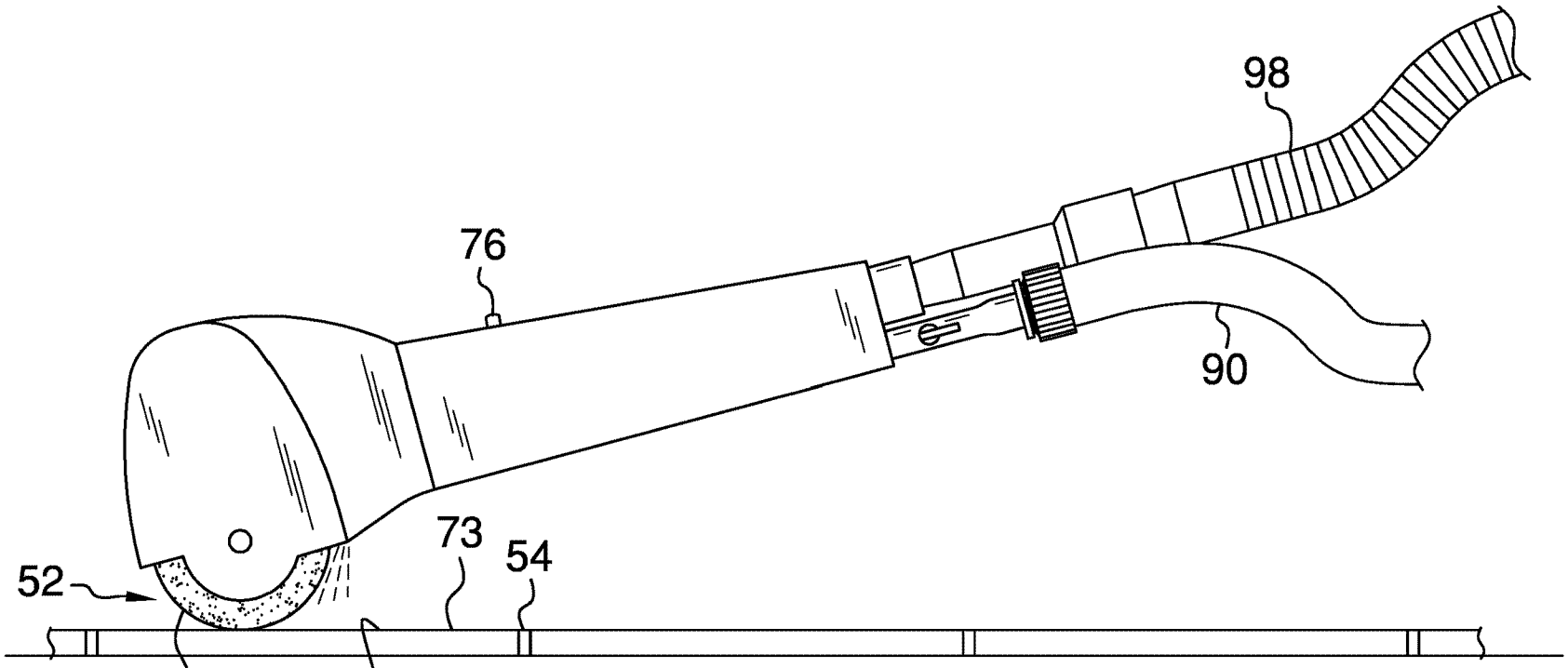
FIG. 5 is a perspective in-use view of an embodiment of the disclosure.

With reference now to the drawings, and in particular to FIGS. 1 through 5 thereof, a new cleaning device embodying the principles and concepts of an embodiment of the disclosure and generally designated by the reference numeral 10 will be described.

As best illustrated in FIGS. 1 through 5, the grout cleaning assembly 10 generally comprises a housing 12 that has a handle portion 14 and a suction portion 16. The suction portion 16 has a front end 18, a rear end 20 and an outer wall

22 extending between the front end 18 and the rear end 20. The outer wall 22 has a bottom side 24, a first lateral side 26 and a second lateral side 28 and each of the first lateral side 26 and the second lateral side 28 flares outwardly between the rear end 20 and the front end 18. The bottom side 24 is concavely arcuate between the front end 18 and the rear end 20 to define a roller space 30 extending between the first lateral side 26 and the second lateral side 28. Each of the first lateral side 26 and the second lateral side 28 has an inner surface 32 and the suction portion 16 is substantially hollow.

The handle portion 14 extends rearwardly from the rear end 20 of the suction portion 16 and the handle portion 14 has a peripheral wall 34. The peripheral wall 34 has a lower side 36, an upper side 38, a first lateral side 40 and a second lateral side 42. The handle portion 14 has a distal end 44 with respect to the suction portion 16 and the handle portion 14 is substantially hollow. Each of the first lateral side 40 and the second lateral side 42 of the handle portion 14 taper inwardly between the rear end 20 of the suction portion 16 and the distal end 44 of the handle portion 14. The handle portion 14 has a conduit 46 extending between the distal end 44 and the bottom side 24 of the suction portion 16. The conduit 46 is in fluid communication with the roller space 30 and the conduit 46 is spaced from the lower side 36 to define a fluid space 48 extending between the distal end 44 and the bottom side 24. The bottom side 24 of the suction portion 16 has a slot 50 extending therethrough and the slot 50 is aligned with the fluid space 48. The slot 50 may be divided into a plurality of sections or the slot 50 may be a single, continuous section.

A scrubbing unit 52 is rotatably attached to the housing 12 and the scrubbing unit 52 is positioned on the suction portion 16. The scrubbing unit 52 scrubs a grout 54 from a support surface 56. The scrubbing unit 52 comprises a first roller 58 that has a first end 60, a second end 62 and an outer surface 64 extending between the first end 60 and the second end 62. The first end 60 is rotatably coupled to the inner surface 32 of the first lateral side 26. The second end 62 is rotatably coupled to the inner surface 32 of the second lateral side 28 such that the first roller 58 is positioned within the roller space 30. Thus, the first roller 58 extends outwardly from the roller space 30 wherein the outer surface 64 of the first roller 58 may abut the support surface 56.

A motor 66 is positioned within the suction portion 16 and the motor 66 is positioned proximate the bottom side 24. The motor 66 may comprise an electric motor or the like. A first pulley 68 is rotatably coupled to the motor 66 such that the motor 66 rotates the first pulley 68 when the motor 66 is turned on and a second pulley 70 is coupled to the first end 60 of the first roller 58. A belt 72 extends between the first pulley 68 and the second pulley 70 such that the motor 66 rotates the first roller 58 when the motor 66 is turned on. Thus, the first roller 58 may scrub the grout 54 from the support surface 56. The support surface 56 may comprise a tile floor and the grout 54 may comprise a tile grout of any conventional design. The first roller 58 may be comprised of a resiliently compressible and fluid absorbent material such as foam rubber or the like. Thus, the first roller 58 serves to remove the grout 54 from an exposed surface 73 support surface 56 without abrading the exposed surface 73 of the support surface 56.

A second roller 74 is rotatably coupled to the housing 16. The second roller 74 is positioned within the conduit 46 such that the second roller 74 engages the outer surface 64 of the first roller 58. The second roller 74 compresses the outer surface 64 wherein the second roller 74 may squeeze a fluid 75 from the first roller 58. The second roller 74 may be comprised of a rigid material.

A switch 76 is attached to the housing 16 and the switch 76 is positioned on the upper side 38 of the handle portion 14. The switch 76 is electrically coupled to the motor 66 such that the switch 76 turns the motor 66 an and off. A power cord 78 is attached to and extends outwardly from the handle portion 14. The power cord 78 is electrically coupled to the switch 76 and the power cord 78 has a distal end 80 with respect to the handle portion 14. The distal end 80 of the power cord 78 has a plug 82 that is electrically coupled thereto and the plug 82 may be electrically coupled to a power source 84. The power source 84 may comprise an electrical outlet or the like.

A first port 86 is coupled to the handle portion 14 and the first port 86 is positioned on the distal end 44 of the handle portion 14. The first port 86 is in fluid communication with the fluid space 48. The first port 86 has a distal end 88 with respect to the handle portion 14 wherein the distal end 88 of the first port 86 may be fluidly coupled to a fluid source 90. The fluid source 90 may be a water hose or the like and the fluid 75 may comprise water.

A valve 92 is attached to the first port 86. The valve 92 is positioned between a closed position and an open position wherein the valve 92 selectively restricts and allows a flow of the fluid 75 into the fluid space 48. The fluid 75 is urged outwardly from the slot 50 and onto the first roller 58 thereby facilitating the first roller 58 to scrub the grout 54 from the support surface 56.

A second port 94 is coupled to the handle portion 14 and the second port 94 is positioned on the distal end 44 of the handle portion 14. The second port 94 has a distal end 96 with respect to the handle portion 14 and the distal end 96 of the second port 94 may be fluidly coupled to a vacuum 98. The vacuum 98 may comprise a wet/dry vacuum or the like. The second port 94 is in fluid communication with the conduit 46 wherein the second port 94 may suctionally urge the fluid 75 and the grout 54 from the first roller 58 into the vacuum 98.

In use, the grout 54 is applied to the support surface 56 and the grout 54 is allowed to dry. The first port 86 is fluidly coupled to the fluid source 90 and the second port 94 is fluidly coupled to the vacuum 98. The valve 92 is positioned in the open position and the switch 76 is manipulated to turn the motor 66 on. The first roller 58 is positioned such that the outer surface 64 of the first roller 58 frictionally engages the support surface 56. The fluid 75 exits the slot 50 in the bottom side 24 and the first roller 58 is soaked with the fluid 75. The first roller 58 scrubs the grout 54 from the support surface 56 after the grout 54 has been applied to the support surface 56 and allowed to dry. The second roller 74 squeezes the grout 54 and fluid 75 mixture from the first roller 58 and the grout 54 and fluid 75 mixture is suctionally urged into the vacuum 98.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A grout cleaning assembly configured to remove excess grout from a tile floor after tile has been installed, said assembly comprising:

a housing having a handle portion and a suction portion, said handle portion having a distal end and a fluid space, said suction portion having a bottom side, said bottom side having slot therein;

a scrubbing unit being rotatably attached to said housing, said scrubbing unit being positioned on said suction portion wherein said scrubbing unit is configured to scrub grout from a support surface;

a first port being coupled to said handle portion wherein said first port is configured to be fluidly coupled to a fluid source, said first port directing a fluid onto said scrubbing unit, said first port being positioned on said distal end of said handle portion, said first port having a distal end with respect to said handle portion, said first port being in fluid communication with said fluid space;

a second port being coupled to said handle portion wherein said second port is configured to be fluidly coupled to a vacuum thereby facilitating said second port to suctionally urge the fluid and the grout into the vacuum when said scrubbing unit scrubs the grout from the support surface;

a first roller; and a valve being attached to said first port, said valve being positioned between a closed position and an open position wherein said valve is configured to selectively restrict and allow a flow of the fluid into said fluid space, the fluid being urged outwardly from said slot in said bottom side thereby facilitating said first roller to scrub the grout from the support surface.

2. The assembly according to claim 1, wherein said suction portion has a front end, a rear end and an outer wall extending between said front end and said rear end, said outer wall having said bottom side, a first lateral side and a second lateral side, each of said first lateral side and said second lateral side flaring outwardly between said rear end and said front end.

3. The assembly according to claim 2, wherein said bottom side is concavely arcuate between said front end and said rear end to define a roller space extending between said first lateral side and said second lateral side, each of said first lateral side and said second lateral side having an inner surface, said suction portion being substantially hollow.

4. The assembly according to claim 1, wherein said handle portion extends rearwardly from said rear end, said handle portion having a peripheral wall, said peripheral wall having a lower side, an upper side, a first lateral side and a second lateral side, said handle portion having a distal end with respect to said suction portion, said handle portion being substantially hollow, each of said first lateral side and said second lateral side of said handle portion tapering inwardly between said rear end of said suction portion and said distal end.

5. The assembly according to claim 4, wherein:

said suction portion has a roller space; and said handle portion has a conduit extending between said distal end and said bottom side of said suction portion, said conduit being in fluid communication with said roller space, said conduit being spaced from said lower side to define a fluid space extending between said distal end and said bottom side, said slot being aligned with said fluid space.

6. The assembly according to claim 1, wherein:

said suction portion has a first lateral side and a second lateral side, each of said first lateral side and said second lateral side having an inner surface, said suction portion having a roller space; and said scrubbing unit comprises a first roller having a first end, a second end and an outer surface extending between said first end and said second end, said first end being rotatably coupled to said inner surface of said first lateral side, said second end being rotatably coupled to said inner surface of said second lateral side such that said first roller is positioned within said roller space having said roller extending outwardly from said roller space wherein said outer surface of said first roller is configured to abut the grout.

7. The assembly according to claim 6, further comprising a motor being positioned within said suction portion, said motor being positioned proximate said bottom side.

8. The assembly according to claim 7, further comprising a first pulley being rotatably coupled to said motor such that said motor rotates said first pulley when said motor is turned on, a second pulley being coupled to said first end of said first roller.

9. The assembly according to claim 8, wherein a belt extending between said first pulley and said second pulley such that said motor rotates said first roller when said motor is turned on wherein said first roller is configured to scrub the grout from the support surface.

10. A grout cleaning assembly configured to remove excess grout from a tile floor after tile has been installed, said assembly comprising:

a housing having a handle portion and a suction portion, said suction portion having a first lateral side, a second lateral side, and a bottom side, each of said first lateral side and said second lateral side having an inner surface, said suction portion having a roller space;

a motor being positioned within said suction portion, said motor being positioned proximate said bottom side;

a first pulley being rotatably coupled to said motor such that said motor rotates said first pulley when said motor is turned on;

a scrubbing unit being rotatably attached to said housing, said scrubbing unit being positioned on said suction portion wherein said scrubbing unit is configured to scrub grout from a support surface, said scrubbing unit including a first roller having a first end, a second end and an outer surface extending between said first end and said second end, said first end being rotatably coupled to said inner surface of said first lateral side, said second end being rotatably coupled to said inner surface of said second lateral side such that said first roller is positioned within said roller space having said roller extending outwardly from said roller space wherein said outer surface of said first roller is configured to abut the grout;

a second pulley being coupled to said first end of said first roller;

a belt extending between said first pulley and said second pulley such that said motor rotates said first roller when said motor is turned on wherein said first roller is configured to scrub the grout from the support surface;

a first port being coupled to said handle portion wherein said first port is configured to be fluidly coupled to a fluid source, said first port directing a fluid onto said scrubbing unit;

a second port being coupled to said handle portion wherein said second port is configured to be fluidly coupled to a vacuum thereby facilitating said second port to suctionally urge the fluid and the grout into the vacuum when said scrubbing unit scrubs the grout from the support surface;

a conduit; and a second roller being rotatably coupled to said housing, said second roller being positioned within said conduit such that said second roller engages said outer surface of said first roller, said second roller compressing said outer surface wherein said second roller is configured to squeeze a fluid from said first roller.

11. The assembly according to claim 1, further comprising:

said handle portion having an upper side;

a motor; and a switch being attached to said housing, said switch being positioned on said upper side of said handle portion, said switch being electrically coupled to said motor such that said switch turns said motor an and off.

12. The assembly according to claim 11, wherein a power cord being attached to and extending outwardly from said handle portion, said power cord being electrically coupled to said switch, said power cord having a distal end with respect to said handle portion, said distal end of said power cord having a plug being electrically coupled thereto wherein said plug is configured to be electrically coupled to a power source.

13. The assembly according to claim 1, wherein:

said handle portion has a distal end and a conduit; and said second port is positioned on said distal end of said handle portion wherein said second port is configured to be fluidly coupled to a vacuum, said second port being in fluid communication with said conduit.

14. A grout cleaning assembly configured to remove excess grout from a tile floor after tile has been installed, said assembly comprising:

a housing having a handle portion and a suction portion, said suction portion having a front end, a rear end and an outer wall extending between said front end and said rear end, said outer wall having a bottom side, a first lateral side and a second lateral side, each of said first lateral side and said second lateral side flaring outwardly between said rear end and said front end, said bottom side being concavely arcuate between said front end and said rear end to define a roller space extending between said first lateral side and said second lateral side, each of said first lateral side and said second lateral side having an inner surface, said suction portion being substantially hollow, said handle portion extending rearwardly from said rear end, said handle portion having a peripheral wall, said peripheral wall having a lower side, an upper side, a first lateral side and a second lateral side, said handle portion having a distal end with respect to said suction portion, said handle portion being substantially hollow, each of said first lateral side and said second lateral side of said handle portion tapering inwardly between said rear end of said suction portion and said distal end, said handle portion having a conduit extending between said distal end and said bottom side of said suction portion, said conduit being in fluid communication with said roller space, said conduit being spaced from said lower side to define a fluid space extending between said distal end and said bottom side, said bottom side having a slot extending therethrough, said slot being aligned with said fluid space;

a scrubbing unit being rotatably attached to said housing, said scrubbing unit being positioned on said suction portion wherein said scrubbing unit is configured to scrub grout from a support surface, said scrubbing unit comprising:

a first roller having a first end, a second end and an outer surface extending between said first end and said second end, said first end being rotatably coupled to said inner surface of said first lateral side, said second end being rotatably coupled to said inner surface of said second lateral side such that said first roller is positioned within said roller space having said roller extending outwardly from said roller space wherein said outer surface of said first roller is configured to abut the grout, a motor being positioned within said suction portion, said motor being positioned proximate said bottom side, a first pulley being rotatably coupled to said motor such that said motor rotates said first pulley when said motor is turned on, a second pulley being coupled to said first end of said first roller, a belt extending between said first pulley and said second pulley such that said motor rotates said first roller when said motor is turned on wherein said first roller is configured to scrub the grout from the support surface, a second roller being rotatably coupled to said housing, said second roller being positioned within said conduit such that said second roller engages said outer surface of said first roller, said second roller compressing said outer surface wherein said second roller is configured to squeeze a fluid from said first roller, a switch being attached to said housing, said switch being positioned on said upper side of said handle portion, said switch being electrically coupled to said motor such that said switch turns said motor an and off, and a power cord being attached to and extending outwardly from said handle portion, said power cord being electrically coupled to said switch, said power cord having a distal end with respect to said handle portion, said distal end of said power cord having a plug being electrically coupled thereto wherein said plug is configured to be electrically coupled to a power source;

a first port being coupled to said handle portion, said first port being positioned on said distal end of said handle portion, said first port being in fluid communication with said fluid space, said first port having a distal end with respect to said handle portion wherein said distal end of said first port is configured to be fluidly coupled to a fluid source;

a valve being attached to said first port, said valve being positioned between a closed position and an open position wherein said valve is configured to selectively restrict and allow a flow of the fluid into said fluid space, the fluid being urged outwardly from said slot in said bottom side thereby facilitating said first roller to scrub the grout from the support surface; and a second port being coupled to said handle portion, said second port being positioned on said distal end of said handle portion wherein said second port is configured to be fluidly coupled to a vacuum, said second port being in fluid communication with said conduit wherein said second port is configured to suctionally urge the fluid and grout from said first roller into the vacuum.

* * * * *